US005417250A

United States Patent [19]

Markey

[11] Patent Number: 5,417,250

[45] Date of Patent: May 23, 1995

[54] WEFT INSERTION SYSTEM FOR AIR-JET LOOM

[75] Inventor: Hugo Markey, Langemark, Belgium

[73] Assignee: Picanol N.V., Belgium

[21] Appl. No.: 217,059

[22] Filed: Mar. 24, 1994

[30] Foreign Application Priority Data

Apr. 6, 1993 [BE] Belgium ..... 09300339

[51] Int. Cl.[6] ..... D03D 47/30

[52] U.S. Cl. ..... 139/435.3; 139/435.1

[58] Field of Search ..... 139/435.1, 435.3

[56] References Cited

U.S. PATENT DOCUMENTS

| | | | |
|---|---|---|---|
| 2,796,085 | 6/1957 | Svaty et al. . | |
| 4,351,369 | 9/1982 | Arakawa | 139/435.1 |
| 4,512,375 | 4/1985 | Deborde et al. | 139/435.3 |
| 4,756,342 | 7/1988 | Van Bogaert | 139/435.3 |
| 4,903,739 | 2/1990 | Tacq | 139/435.3 |

FOREIGN PATENT DOCUMENTS 9202328 7/1992 Germany .

OTHER PUBLICATIONS

Dornier brochure (no date or place of publication supplied also no translation).

*Primary Examiner*—Andrew M. Falik

*Attorney, Agent, or Firm*—Bacon & Thomas

[57] ABSTRACT

A weft insertion system for an air-jet loom includes at least one main blower nozzle and a compressed air supply for the main blower nozzle, the compressed air supply including stationary components and components which move together with the main blowing nozzle, the stationary and movable components being connected by a compressed-air conduit which extends between an outlet of one of the stationary components to an intake of one of the movable components. The stationary components are mounted in such a manner that the outlet of the stationary components is located above the intake of the components which move together with the main blower nozzle and, furthermore, is mounted approximately centrally with respect to the end positions of the movement of the moving components.

11 Claims, 2 Drawing Sheets

WEFT INSERTION SYSTEM FOR AIR-JET LOOM

FIELD OF THE INVENTION

The invention concerns a weft insertion system for airjet looms of the type including at least one main blower nozzle mounted on a batten and means for supplying compressed air to the main blower nozzle, and in which the compressed air supply means includes at least one stationary component and components that are displaced together with the batten and main blower nozzle, the stationary and displaceable components being connected by a flexible compressed-air conduit positioned between an outlet of the stationary components and an intake of the displaceable components.

DESCRIPTION OF RELATED ART

In an insertion system of the type described above, the compressed-air conduit must deform because of the relative motion between the stationary components and the components which are displaced or moved along with the batten and the main blowing nozzle. In order to minimize wear and stress on the compressed-air conduit, the conduit is kept relatively long. Such an arrangement is disadvantageous because, as a result of the length of the conduit, large pressure drops are incurred in the conduit, and the operation of the main blowing nozzle may be degraded.

The pressure drops incurred as a result of the comparatively substantial length of the compressed air conduit may be reduced by enlarging the diameter of the conduit. However, enlargement of the conduit diameter has the disadvantage that the increased volume which must be filled slows the rise in air pressure of the conduit, especially when the compressed-air conduit is mounted between a valve and the main blower nozzle, and a correspondingly long time elapses until the pressure at the main blower nozzle has built-up.

SUMMARY OF THE INVENTION

It is accordingly an objective of the invention to provide an improved insertion system for an air-jet loom which solves the problems of large pressure drops and/or slow pressurization caused by the length or diameter of the air pressure conduit, as well as other problems presented by known systems as will become apparent from the following description.

In a preferred embodiment of the invention, the problems resulting from the use of flexible conduits are solved by mounting the stationary components above the main blowing nozzle so that the outlet of the stationary components is substantially above the intake of the components which move together with the main blower nozzle, thereby minimizing the length of the compressed-air conduit without exposing the compressed-air conduit to high stresses and related wear. Conduit losses are kept low even for conduits of relatively small cross-sections, allowing rapid pressure build-up.

Further advantages and features of the invention will become apparent from the description below of an illustrative embodiment of the invention.

DETAILED DESCRIPTION OF THE PREFERRED EMBODIMENTS

Figure 1:
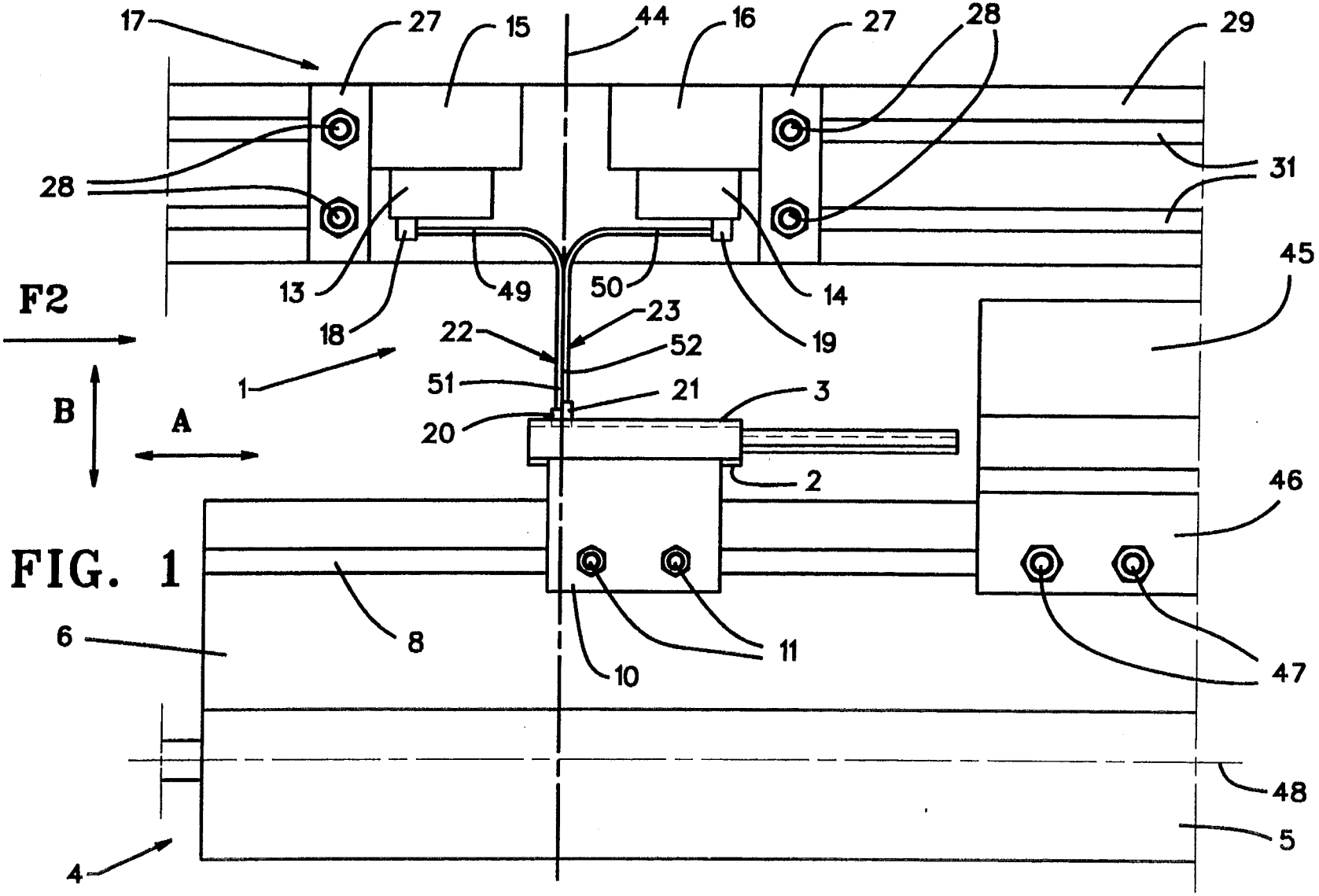
FIG. 1 is a front view of the weft insertion system of a preferred embodiment of the invention.
Figure 2:
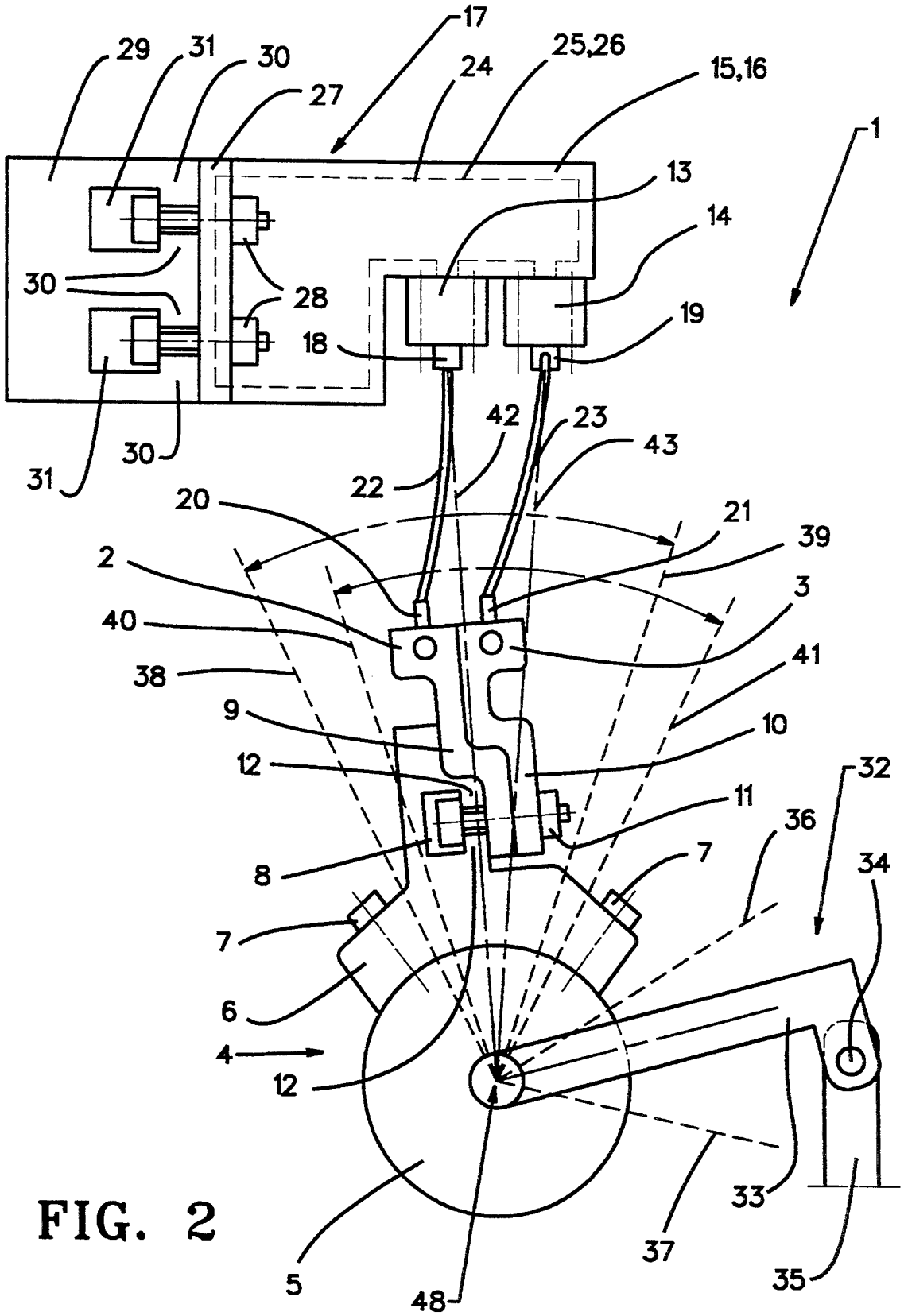
FIG. 2 is a view in the direction of the arrow F2 of FIG. 1.

The insertion system 1 shown in FIGS. 1 and 2 includes two main blower nozzles 2, 3 mounted on a batten 4. The batten 4 is equipped with a batten shaft 5 to which a longitudinal fitting 6 is affixed by screws 7. The batten fitting 6 includes an undercut groove 8 running in the longitudinal direction A of the fitting and therefore in the direction of the batten shaft 5. The main blower nozzles 2, 3 each are provided with a holder 9, 10 affixed by screws 11 to the strips 12 on both sides of the longitudinal groove 8. This kind of fastening allows displacement of the main blowing nozzles 2, 3 longitudinally (A, direction of the batten shaft 5). Such displacements are advantageous in order to match the position of the main blower nozzles 2, 3 to different widths of the fabric to be woven.

The insertion system 1 moreover includes switch-controlled valves 13, 14 associated with the main blower nozzles 2, 3. These valves 13, 14 are affixed to fittings 15, 16 of a holder 17. The outlets 18, 19 of the valves 13, 14 are connected by compressed-air conduits 22, 23 to the intakes 20, 21 of the main blower nozzles 2, 3. In addition, a reed 45 (see FIG. 1) is fastened by a clamp 46 and screws 47 to batten fitting 6. The screws 47 cooperate with the longitudinal groove 8 of the batten fitting.

At least one compressed-air tank 24 or buffer is present in the holder 17 and communicates through conduits 25, 26 inside the fittings 15, 16 with the valves 13, 14. The compressed-air tank 24 and the conduits 25, 26 are shown by dashed lines in FIG. 2. This configuration allows pressure losses to be minimized in the conduits 25, 26. The holder 17 includes side components 27 fitted with screws 28 for fastening the holder 17 to a fluted support 29 of the machine frame. The support 29 includes at least one undercut, longitudinal channel 31 bounded by strips 30 and extending in the longitudinal direction A parallel to the batten shaft 5. This kind of fastening allows adjustment of the holder 17 together with the compressed-air tank 24 and the valves 13, 14 in a simple and rapid manner in the longitudinal direction A. Furthermore, the valves 13, 14 are easily exchangeable in case of malfunctions.

The batten 4 is fitted with a drive 32 shown schematically in FIG. 2. This drive 32 includes, for example, a lever 33 affixed to the batten shaft 5 and connected by a pin 34 to a drive rod 35. The lever 33 together with the batten shaft 5 can be rotated to-and-fro about the axis of rotation 48 between the end positions 36, 37 shown by dashed lines. Because of this motion, the intake 20 of the main blower nozzle 2 is moved to-and-fro about the axis of rotation 48 between end positions 38, 39 also shown by dashed lines. In the same manner, the intake 21 of the main blowing nozzle 3 is moved to-and-fro about the axis of rotation of the batten shaft 5 between the end positions 40, 41 shown in dashed lines.

As illustrated in particular by FIG. 2, the outlets 18, 19 of the two valves 13, 14 are not only mounted above the intakes 20, 21 of the corresponding main blowing nozzles 2, 3, but moreover are still mounted in such a way that the outlets 18, 19 of the valves 13, 14 in each case are nearly central with respect to the end positions 38, 39 and 40, 41 of the intakes 20, 21 of the associated main blowing nozzles 2, 3. When viewed in the longitudinal direction A, the outlet 18 of the valve 13 is located approximately on the angle bisector 42 between the end positions 38, 39. In corresponding manner, when viewed in the longitudinal direction A, the outlet 19 of the valve 14 is also located approximately on the bisector 43 between the end positions 40, 41 of the main blowing nozzle 3.

As illustrated in FIG. 1, the outlets 18, 19 of the valves 13, 14 are mounted at least approximately mirror-symmetrically relative to surface 44 and extend transversely to batten shaft 4 through the region of the intakes 20, 21 of the main blowing nozzles 2, 3. The intakes 20, 21 of the main blowing nozzles 2, 3 also are mounted at least approximately symmetrically relative to plane 44. This design allows the compressed-air conduits 22, 23 to have approximately equal lengths. Advantages are achieved thereby regarding control of the compressed-air supply to the main blower nozzles 2, 3 because the time delays until reaching full pressure at the intakes 20, 21 of the main blowing nozzles 2, 3 are mutually balanced. Because the compressed-air conduits 22, 23 are respectively displaced in operation to both sides of the stationary outlets 18, 19 of the valves 13, 14, they are stressed only a little and as a result undergo little wear. Consequently the compressed-air conduits 22, 23 can be made comparatively short, for example about 10 to 20 cm long.

In the illustrated embodiment, the compressed-air lines 22, 23 include segments 49, 50 extending in the longitudinal direction A of the batten 4 (parallel to the batten shaft 5) which are connected to the outlets 18, 19 of the valves 12, 13. These compressed-air lines 22, 23 furthermore include segments 51, 52 which run essentially radially to the batten shaft (in the direction B orthogonal to direction A), and which are connected to the intakes 20, 21 of the main blowing nozzles 2, 3. Because of this design, deformations of the compressed-air conduits 22, 23 during motion of the batten 4 are relatively minor.

In a variation of this embodiment, segments running in the longitudinal direction A may be connected to the intakes of the main blower nozzles 2, 3 and segments running essentially in the radial direction may be connected to the outlets 18, 19 of valves 13, 14. Other variations and combinations of the above designs are also feasible.

In another variation of the illustrated embodiment, more than two main blowing nozzles 2, 3 are provided, which in turn cooperate with more than two switch-controlled valves 13, 14. For this purpose, several valves may be mounted to the fittings 15, 16 of the holder 17, all the valves being located essentially centrally between the end positions of the intakes of the corresponding number of main blower nozzles. Furthermore, several compressed-air tanks may be present in the holder 17 with, by way of example, one tank for each conduit 25, 26.

When adjusting or setting up the loom, the main blower nozzles 2, 3 are displaced in the longitudinal groove 8 adjacent the reed 45, and thereupon the main blower nozzles 2, 3 are affixed by the screws 11 to the batten fitting 6. The holder 17 also is displaced along the support 29 until the valves 13, 14 are nearly symmetrical to the radial surface 44, after which the holder 17 is fastened in place on the support 29 by the screws 28.

In the embodiment shown, the means for supplying compressed air to the main blowing nozzles 2, 3 (aside from the compressed-air supply for the compressed-air tank 24, which is not shown) include the compressed-air tank 24 and valves 13, 14 with outlets 18, 19 in the form of stationary components. The components which move together with the main blowing nozzles 2, 3 in this case include only the intakes 20, 21 of the main blowing nozzles 2, 3. In other variations of this embodiment, the switch-controlled valves 13, 14 may be fastened directly to the holders 9, 10 of the main blower nozzles 2, 3, directly to the main blower nozzles 2, 3, or to the batten 4, as a result of which these valves together with their intakes belong to the components displaced together with the main blower nozzles 2, 3.

The support 29 is part of the machine frame and is mounted so that it is located outside the shed-forming mechanism and thus the operation of the shed forming mechanism is not affected by the support 29. It is noted, furthermore, that this type of system does not require a specific shed-forming mechanism, but rather is applicable to a variety of shed-forming mechanisms such as Jacquard or dobby systems, cog or cam systems, and to a variety of other systems. These variations and any other modifications of the invention which may occur to a skilled artisan are all intended to be included within the scope of the invention and, accordingly, those skilled in the art will appreciate that the invention is not to be limited by the above description, but rather is to be interpreted solely in accordance with the appended claims.

I claim:

1. In a weft insertion system for an air-jet loom which comprises at least one main blower nozzle mounted on a batten for movement therewith, and means for supplying compressed air to the main blower nozzle, said air supply means including at least one stationary component and a component which moves together with the main blowing nozzle, said movement of the movable component and the main blowing nozzle being between end positions of the movable component and the main blowing nozzle, and a flexible compressed-air conduit present between an outlet of the stationary component and an intake of the movable component, the improvement wherein:

the stationary component is mounted above the main blower nozzle such that the outlet of the stationary component is essentially located above the intake of the moving component.

2. An insertion system as claimed in claim 1, wherein the the stationary component is mounted approximately centrally between said two end positions of the movable component and the main blower nozzle.

3. An insertion system as claimed in claim 2, wherein the stationary component is mounted on a bisector of an angle defined by said two end positions and a rotational axis of said batten.

4. An insertion system as claimed in claim 1, wherein the stationary component is mounted on a machine-frame support which extends parallel to a shaft of the batten.

5. An insertion system as claimed in claim 4, wherein the said support includes means for allowing longitudinal displacement of the stationary component in a direction parallel to a direction in which the support extends.

6. An insertion system as claimed in claim 4, wherein the stationary component is mounted to the support such that said outlet is offset in an axial direction of the batten toward the intake of the movable component.

7. An insertion system defined in claim 6, wherein the compressed-air conduit includes a segment which extends approximately radially to the batten shaft, and a segment which extends approximately parallel to the batten shaft.

8. An insertion system as claimed in claim 1, wherein the stationary component includes a compressed-air tank located in a holder which affixes the stationary components to a support.

9. An insertion system as claimed in claim 1, wherein the stationary component includes a valve, and said outlet is an outlet of said valve.

10. An insertion system as claimed in claim 1, wherein the moving component includes a valve, an intake of which communicates with an outlet of a stationary compressed-air tank.

11. An insertion system as claimed in claim 1, wherein two main blower nozzles are mounted to the batten and said air supply means includes first air supply means for supplying compressed air to one of the main blower nozzles and second air supply means for supplying compressed air to the other of the two blower nozzles, wherein each of the first and second air supplies includes a plurality of said stationary components, and wherein the two main blower nozzles are mounted to the batten such that the intakes of respective movable components moving together with the main blower nozzles are located at least approximately in a common radial surface and such that the stationary components of said first air supply means are mounted to a support on one side of the radial surface and the stationary components of said second air supply means are mounted on the other side of the radial surface.

* * * * *